US007002567B1

(12) United States Patent
Ito et al.

(10) Patent No.: US 7,002,567 B1
(45) Date of Patent: Feb. 21, 2006

(54) METHOD FOR DRIVING DISPLAY PANEL

(75) Inventors: Atsushi Ito, Tokyo (JP); Hironobu Arimoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/019,310

(22) PCT Filed: May 15, 2000

(86) PCT No.: PCT/JP00/03076

§ 371 (c)(1),
(2), (4) Date: Jan. 9, 2002

(87) PCT Pub. No.: WO01/88894

PCT Pub. Date: Nov. 22, 2001

(51) Int. Cl.
*G09G 5/00* (2006.01)

(52) U.S. Cl. ..... 345/208; 345/60; 315/169.1

(58) Field of Classification Search ..... 345/60, 345/63, 66–68, 208; 315/169.1, 169.3, 169.4
See application file for complete search history.

(56) References Cited

U.S. PATENT DOCUMENTS

| | | | | |
|---|---|---|---|---|
| 4,001,636 | A * | 1/1977 | Tottori | 345/66 |
| 5,446,344 | A * | 8/1995 | Kanazawa | 315/169.4 |
| 5,483,252 | A * | 1/1996 | Shigeta | 345/67 |
| 5,663,741 | A * | 9/1997 | Kanazawa | 345/66 |
| 5,982,344 | A * | 11/1999 | Tokunaga | 345/67 |
| 6,054,970 | A * | 4/2000 | Hirakawa et al. | 345/60 |
| 6,169,527 | B1 * | 1/2001 | Kanazawa et al. | 345/60 |
| 6,281,863 | B1 * | 8/2001 | Sasaki et al. | 345/60 |
| 6,320,561 | B1 | 11/2001 | Hironobu | |
| 6,483,249 | B1 * | 11/2002 | Ito et al. | 315/169.3 |
| 6,597,334 | B1 * | 7/2003 | Nakamura | 345/68 |
| 2002/0044106 | A1 * | 4/2002 | Iseki | 345/60 |

FOREIGN PATENT DOCUMENTS

| | | |
|---|---|---|
| CN | 1249498 | 4/2000 |
| EP | 908919 | 4/1999 |
| EP | 991051 | 4/2000 |
| EP | 991052 | 4/2000 |
| EP | 997923 | 5/2000 |
| JP | 4-291391 | 10/1992 |
| JP | 4-322297 | 11/1992 |
| JP | 7-140927 | 6/1995 |
| JP | 8-212930 | 8/1996 |
| JP | 8-278766 | 10/1996 |
| JP | 9-325736 | 12/1997 |
| JP | 10-143106 | 5/1998 |
| JP | 10-143108 | 5/1998 |

* cited by examiner

*Primary Examiner*—Alexander Eisen
*Assistant Examiner*—Kimnhung Nguyen
(74) *Attorney, Agent, or Firm*—Oblon, Spivak, McClelland, Maier & Neustadt, P.C.

(57) ABSTRACT

A method for driving a display panel, in which a false gaseous discharge of a display cell is prevented via an initialization sequence containing a reset pulse and an initialization pulse. Stable initialization is achieved by applying the initialization pulse to the common electrode after the reset pulse. The initialization pulse rises up in one step. Alternatively, the initialization pulse is a complex pulse having second-step pulse that rises up within 1 μs after the rise of its first-step pulse. A stabilization sequence can be inserted between the initialization sequence and a discharge maintenance sequence.

11 Claims, 15 Drawing Sheets

METHOD FOR DRIVING DISPLAY PANEL

TECHNICAL FIELD

The present invention relates to a method for driving a discharge panel that provides a display by gaseous discharge.

More particularly, the invention pertains to a method for driving a display panel of the type wherein a common electrode and a discrete electrode are connected to each of plural display cells arranged in a matrix form, a display pulse for display operation is applied to the common electrode and a control voltage for controlling a discharge at each display cell is applied to the discrete electrode to control gaseous discharge at each display cell to thereby provide an image display.

BACKGROUND ART

There has been known so far a panel that produces a display by controlling a gaseous discharge for each display cell, such as a plasma display panel. For normal discharge in such a display panel it is necessary that charges stored be always held in a state suitable for discharge. To this end, it is customary in the art to regularly initialize all the display cells as by removing stored charges that trigger an unintended discharge.

Such initialization schemes are described, for example, in JP-A-10-143106, JP-A-8-278766, JP-A-7-140927, JP-A-9-325736 and JP-A-8-212930.

While various initialization schemes have thus been proposed, it is required to perform initialization that matches each particular discharge stricture, discharge condition and panel driving method.

The inventor of the present invention has filed a patent application on an initialization sequence including a negative reset pulse (Japanese Pat. Appln. Hei 10-276735 filed Sep. 30, 1998; U.S. application Ser. No. 09/261,260 filed Mar. 3, 1999). This case is an improvement on his previous invention.

A description will be given first of the invention described in the above patent application.

FIG. 16 is a diagram schematically depicting a gaseous discharge display panel and its drive circuit in their entirety.

The panel has 640 by 480 pixels arranged in a matrix form. Unit panels 11, 12, . . . 140, 21, 22, . . . 240, . . . , 301, 302, . . . 3040, each consisting of 16 by 16 pixels, are arranged with 40 rows and 30 columns to form the panel in its entirety.

Each electrode is connected to a common electrode and a discrete electrode. By controlling the voltage of the discrete electrode while applying display pulses to the common electrode, discharge at each pixel is controlled to thereby perform ON/OFF control of display.

And 640 by 480 pieces of data necessary for controlling the voltages of the discrete electrodes of the entire panel are input as data of one frame to a video interface circuit 100.

The data of one frame is provided from the video interface circuit 100 to the unit panels via 30 bus circuits 101, 102, . . . , 130.

The first bus circuit 101 extracts 640 by 16 pieces of data from the 640 by 480 pieces of data, and sends them to the 40 unit panels 11, 12, . . . , 140. Based on addresses assigned to the data, the unit panels 11, 12, . . . , 40 each receive 16 by 16 pieces of data.

In the unit panels 11, 12, . . . , 140 one piece of data is allocated to each pixel by a drive shift register to control the voltage of the discrete electrode. Each piece of data consists of 24 bits. They are eight bits for R (red), eight bits for G (green) and eight bits for B (blue). The 8-bit data is used to control the brightness of display in 256 steps.

The other bus circuits 102, . . . , 130 also respectively extract 640 by 16 pieces of data and send them to the unit panels 21, 22, . . . , 240, . . . , 301, 302, . . . ,3040. And the unit panels 21, 22, 240, 301, 302, . . . , 3040 each receive 16 by 16 pieces of data and control voltages of discrete electrodes of the 16 by 16 pixels.

The 640 by 480 pieces of data of one frame are input as data of one frame during pulse intervals of a vertical sync signal V. sync shown in FIG. 17(*a*). A horizontal sync signal H. sync shown in FIG. 17(*b*) is generated 480 times per frame. A single horizontal sync signal H. sync is followed by 640 pieces of data being input.

In this display panel each display cell is connected to the common electrode and the discrete electrode; the discrete electrode is driven for each display cell and the common electrode is driven in common to plural cells. And display pulses are applied to the common electrode and the application of a positive control voltage by the discrete electrode is controlled for each cell, by which a discharge is controlled for each display cell to provide a display. The display pulse of the common electrode and the control voltage of the discrete electrode are produced for each unit panel and provided to each display cell.

FIG. 18 depicts the common electrode-applied display pulse, the discrete electrode control voltage and discharge waveform for each frame. FIG. 18 shows the case of a stable discharge. Each frame starts with an initialization sequence, followed by display sequences.

In the duration of one display pulse the discharge is generated twice. The first discharge is a storage discharge and the second an erasing discharge. Positive rise-up of the discrete electrode control voltage stops the discharge. The rise-up timing of the discrete electrode control voltage is controlled by the 8-bit data in 256 steps. Accordingly, the brightness of display is also controlled in 256 steps. When the positive rise-up timing of the discrete electrode control voltage is brought forward, the frequency of occurrence of the discharge decreases, reducing the brightness of display.

FIG. 19 is a diagram showing the relationship between the voltage of the common electrode and the discharge in the initialization sequence depicted in FIG. 18. The left-hand side is the common electrode and the right-hand side the discrete electrode.

The display pulse is formed by a two-step voltage, which increases and decreases in stages; the absolute value of the voltage of a reset pulse may preferably be set above the first-stage voltage value of the display pulse. With such a display pulse, it is possible to cause two discharges, i.e. a charge storage discharge and a stored charge removal discharge, by one shot of the display pulse. Then, when a stable discharge takes place, no reset pulse needs to be inserted.

Incidentally, it is preferable to apply the reset pulse once for each or plural frames. This provides frames free from the necessity of inserting reset pulses, imparting flexibility to the processing involved.

Potentials and charges of the both electrodes at times (1) through (6) are described below. The left-hand side is the common electrode and the right-hand side the discrete electrode.

At time (1) the voltages of the both electrodes are 0 V, and no discharge occurs. At time (2) the voltage of the common electrode reaches 360 V, causing a discharge. This is the storage discharge. Negative charges resulting from the discharge are attracted to the common electrode, whereas positive charges are attracted to the discrete electrode. At time (3), the effective voltage of the common electrode drops below 360 V due to the negative charges attracted thereto, stopping the discharge. At time (4), when the voltage of the common electrode is reduced down to 0 V, a discharge is caused by the potential difference between the both electrodes due to the charges attracted to them. This is removal discharge. At time (5) the discharge stops and the stored charges also disappear. At time (6) a reset pulse of −180 V is applied to the common electrode, but no change occurs since no stored charges exist in this case.

The common electrode in this display panel is driven using a complex display pulse whose voltage changes in two stages. And the charge storage discharge and the stored charge removal discharge are carried out by a single shot of this complex display pulse. Accordingly, it is possible, theoretically, that charges are automatically removed even if the display discharge is repeated. In practice, however, charges are stored and remain unremoved due to insufficient voltage application and the repetition of charge and discharge operations, resulting in the display becoming unstable.

As a solution to this problem, it is conventional to initialize the discharge cell condition through the inversion of charges at the display cell by applying a positive pulse to every discrete electrode once per frame or frames, or applying a negative pulse (a reset pulse) during intervals between successive applications of display pulses to the common electrode. The application of one complex display pulse and one reset pulse is referred to as an initialization sequence.

FIGS. 20 and 21 are diagrams showing how charges stored by an unstable discharge are removed by the reset pulse.

FIG. 20 shows the display pulse to the common electrode and the discrete electrode control voltage and the discharge waveforms in one frame. What are depicted in FIG. 20 are the same as those in FIG. 18 except that a discharge is caused by the reset pulse of the initialization sequence.

FIG. 21 shows the relationship between the voltage and discharge at the common electrode in the initialization sequence depicted in FIG. 20. The operations at times (1) through (4) are the same as in FIG. 19. At time (5) negative charges are stored on the common electrode due to an unstable discharge. Even if the display pulse of 360 V is applied to the common electrode in the next cycle (2) while leaving the negative charges unremoved, the effective voltage of the common electrode does not reach 360 V, and a discharge is hard to occur. Then, at time (6) the reset pulse of −160 V is applied to the common electrode to discharge the stored charges. At time (7) after the discharge positive charges are attracted to the common electrode, and negative charges are attracted to the discrete electrode. Since the positive charges are stored on the common electrode, its discharge will not be hindered by the stored charges when the display pulse is applied to the common electrode in the next display cycle (2). In this instance, since the stored charges on the common electrode are positive, the application of the display pulse raises its effective voltage above the applied voltage, facilitating the discharge. This gives rise to another problem. The display pulse is applied at 160 to 180 V in the first stage and 320 to 360 V in the second stage; however, facilitating the discharge by the stored charges leads to the occurrence of a false discharge in the first stage.

In controlling the entire display panel, characteristic variations are caused in the panel according to its manufacturing conditions, and only with the above-mentioned discharge stabilization scheme, it is impossible to provide a sufficient voltage width (margin) for control, giving rise to the problem of false discharge. Further, characteristic variations are also present for each panel; to solve these problems, it is necessary to maintain stable discharge and provide a sufficient margin.

Moreover, the initialization sequence is effective for a cell in an unstable state, but it means a voltage change ineffective for stable discharge, sometimes making the stable discharge unstable. Accordingly, it is necessary that the initialization sequence be adapted not to affect the stable cell.

Additionally, data to be provided to the discrete electrode for individual control of each cell is usually transferred from a logic circuit, and a high voltage driver IC is used to control the cell. At this time, high-voltage switching on the part of the common electrode causes noise in no small way, which affects the data by the logic circuit, leading to a false display. Accordingly, it is necessary to reduce noise in the sequence for the common electrode and the transfer of data for each cell.

DISCLOSURE OF THE INVENTION

An object of the present invention is to prevent a false discharge that is caused by the reset pulse of the initialization sequence.

Another object of the present invention is to maintain stable discharge by providing a sufficient voltage margin of the display pulse, thereby preventing a false discharge resulting from characteristic variations for each panel.

Another object of the present invention is to prevent a stable cell from being affected by the initialization sequence.

Still another object of the present invention is to reduce noise that is caused in the data to be sent to the discrete electrode by the high-voltage switching on the part of the common electrode.

The display panel driving method according to an aspect of the present invention is a method for driving a display panel wherein a common electrode and a discrete electrode are connected to each of plural display cells arranged in a matrix form, an initialization sequence voltage is applied to the common electrode, then a display pulse for display operation is applied to the common electrode, and a control voltage for controlling the discharge period in each display cell is applied to discrete electrode, thereby controlling the gaseous discharge in each display cell; the above-mentioned initialization sequence comprises the following steps (a) and (b).

(a) Step of supplying the common electrode with a reset pulse opposite in polarity to the display pulse for the inversion of charges stored on the said electrode.

(b) Step of supplying the common electrode with a single-step pulse of the same polarity as that of the display pulse to the common electrode.

Since the pulse in step (b) of the initialization sequence is a single-step, no false discharge results from the inversion of the charges in step (a).

The display panel driving method according to another aspect of the present invention is a method that uses, in place of the single-step pulse in said step (b), a dual-step pulse whose second-step pulse rises up within 1 $\mu$s after the rise-up of first-step pulse.

Since the pulse in step (b) of the initialization sequence rises in the second step within 1 $\mu$s after the first-step rise, no false discharge results from the inversion of the charges in step (a).

The display panel driving method according to another aspect of the present invention is a method for driving a display panel wherein a common electrode and a discrete electrode are connected to each of plural display cells arranged in a matrix form, an initialization sequence voltage is applied to the common electrode, then a display pulse for display operation is applied to the common electrode, and a control voltage for controlling the discharge period in each display cell is applied to discrete electrode, thereby controlling the gaseous discharge in each display cell; in this method, the period in which data for controlling the discharge period of each display cell is transferred to a drive circuit of the discrete electrode is set in the period during which no voltage is applied to the common electrode.

Since the data transfer is carried out while no voltage is applied to the common electrode, it is possible to prevent noise from being caused in the data transferred.

The display panel driving method according to another aspect of the present invention is a method for driving, by the following sequences (a), (b) and (c), a display panel wherein a common electrode and a discrete electrode are connected to each of plural display cells arranged in a matrix form.

(a) Initialization sequence for applying an initialization voltage to the common electrode.

(b) Stabilization sequence for applying a display pulse for display operation to the common electrode to perform a gaseous discharge of each display cell.

(c) Maintenance sequence for controlling the gaseous discharge period of each display cell by controlling the period in which to apply a display pulse for display operation to the common electrode and a discharge suppression pulse to the discrete electrode.

Since the stabilization sequence is provided between the initialization sequence and the maintenance sequence, each cell state stabilizes, preventing its false discharge.

The display panel driving method according to still another aspect of the present invention is a method in which the period in which not to apply voltages to both of the common electrode and the discrete electrode is set between the sequences (a) and (b), or between the sequences (b) and (c), or in place of the sequence (b).

The false discharge can be prevented by setting a stabilization period in which no voltages are applied to the common electrode and the discrete electrode.

BEST MODE FOR CARRYING OUT THE INVENTION

Next, a description will be given, with reference to the accompanying drawings, of the display panel driving method according to the present invention.

Embodiment 1

Figure 1:
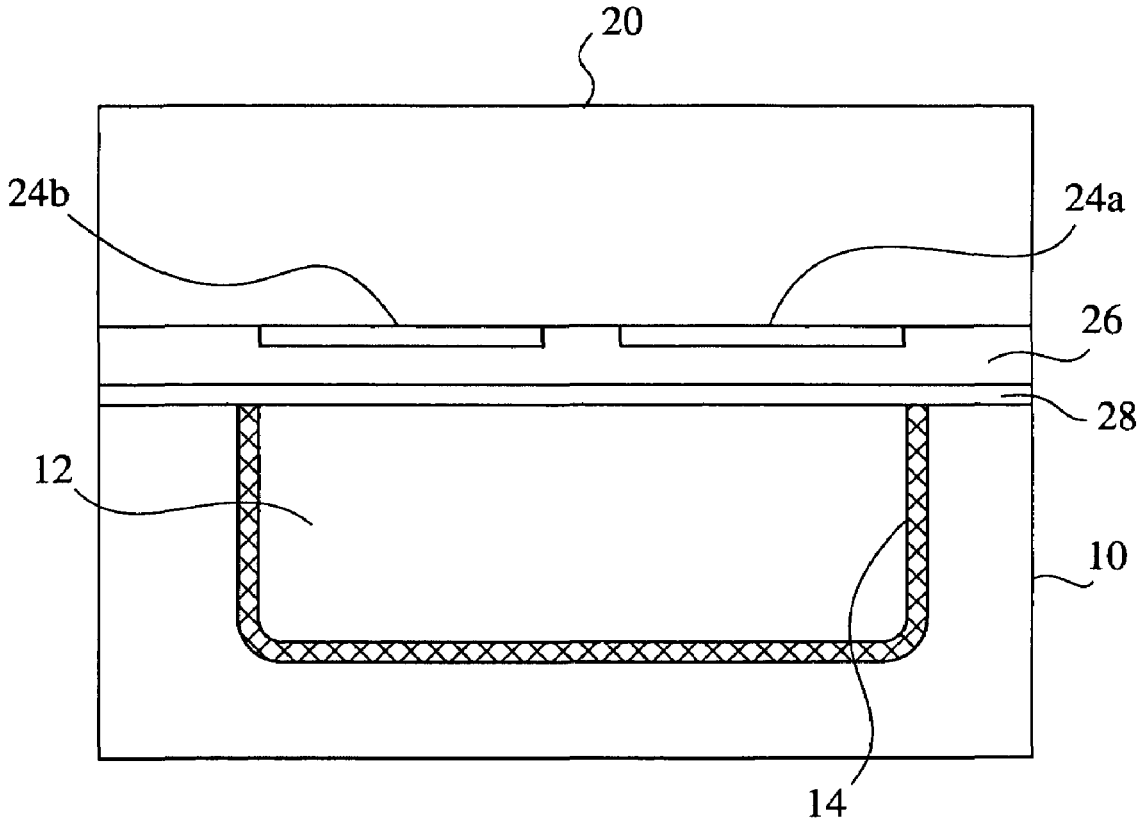
FIG. 1 is a diagram showing the electrode structure of one display cell.

FIG. 1 is a diagram depicting one display cell (one color) in the display panel that embodies the present invention. The display panel has its back covered with a back glass board 10. A recess 12 made in the back glass board 10 is coated all over its interior surface with a fluorescent layer 14. On the back of a front glass board 20 (on the side facing the back glass board 10) there are disposed a pair of transparent electrodes 24*a* and 24*b*. A dielectric layer 26 is formed covering them, and is coated with a protective film 28. Accordingly, the protective film 28 usually formed of MgO faces the recess 12. And, by applying a positive display pulse to the common electrode and holding the discrete electrode at a sufficiently low voltage (for example, 0 V), a discharge is caused in a portion of the recess 12 adjacent the protective film. Applying a positive voltage to the discrete electrode, the voltage value between the discrete electrode and the common electrode reduces, stopping the discharge.

Figure 2:
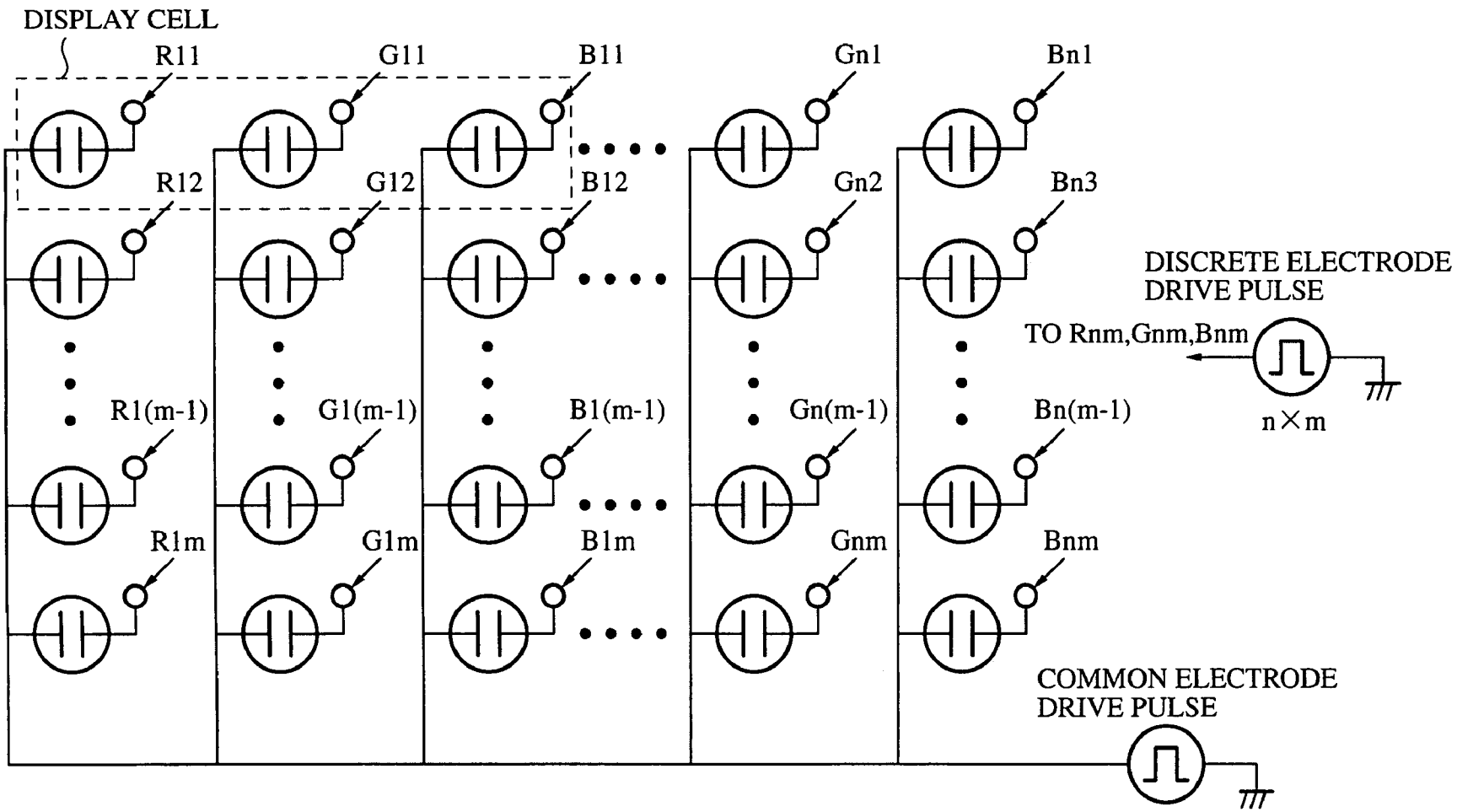
FIG. 2 is a diagram depicting an array of display cells that are driven by the display panel driving method of the present invention.
Figure 3:
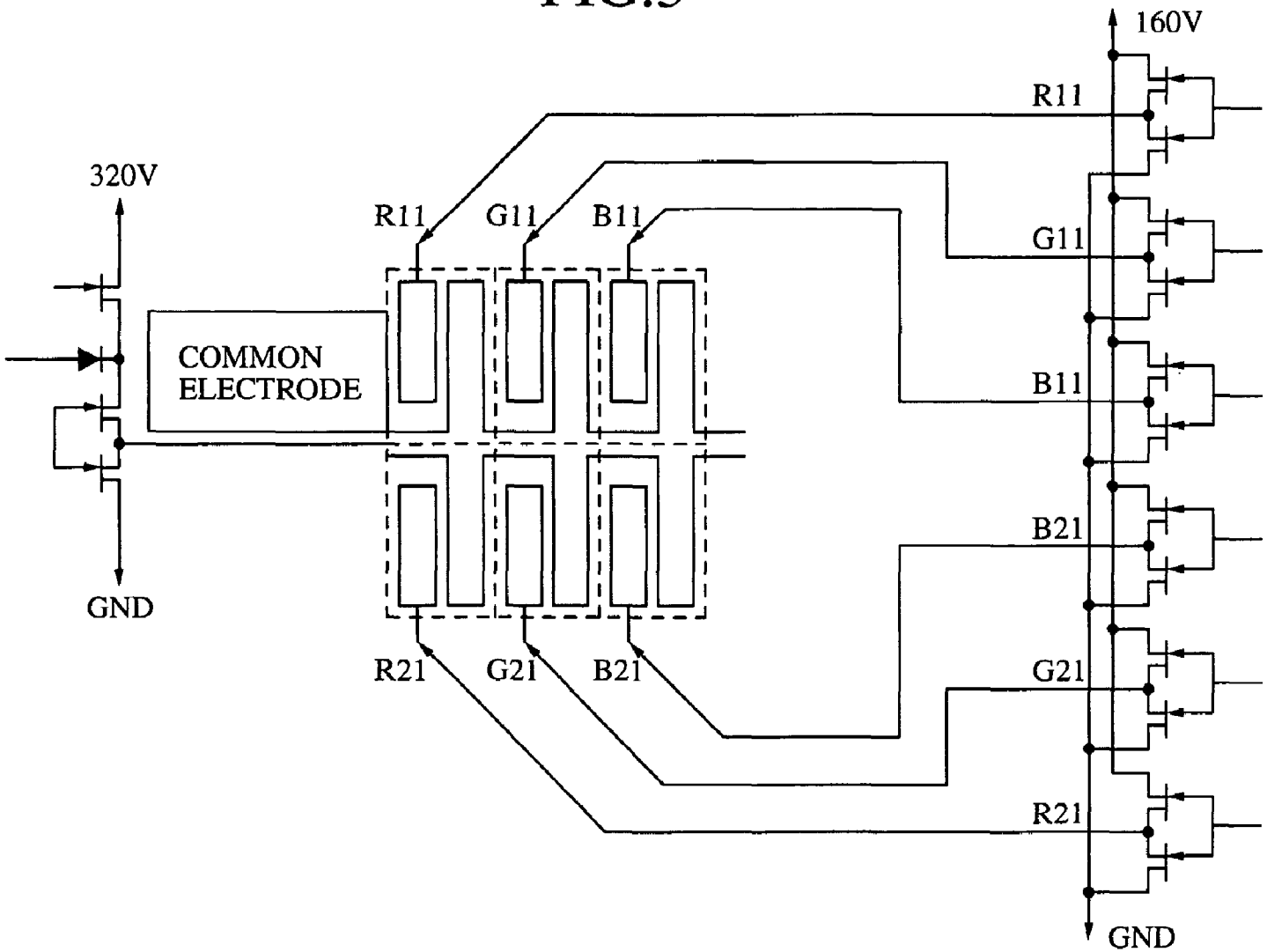
FIG. 3 is a diagram showing the connection between the electrode of one display cell and its drive circuit.

FIG. 2 illustrates in block form the configuration of a unit display panel, and FIG. 3 shows in block form the connections of discharge cells and their drive circuits.

The unit display panel comprises cells arranged in the form of a n by m matrix. In this embodiment n=m=16. One display cell consists of red (R), green (G) and blue (B). Each display cell has a common electrode and discrete electrode. The common electrode of every cell is supplied with a common electrode drive pulse. Applied to the common electrode are GND, 160 V, 320 V and negative voltages. The discrete electrode of each display cell is supplied with a different discrete electrode drive pulse. Upon application of a 160-V pulse to the discrete electrode, the discharge stops.

Figure 4:
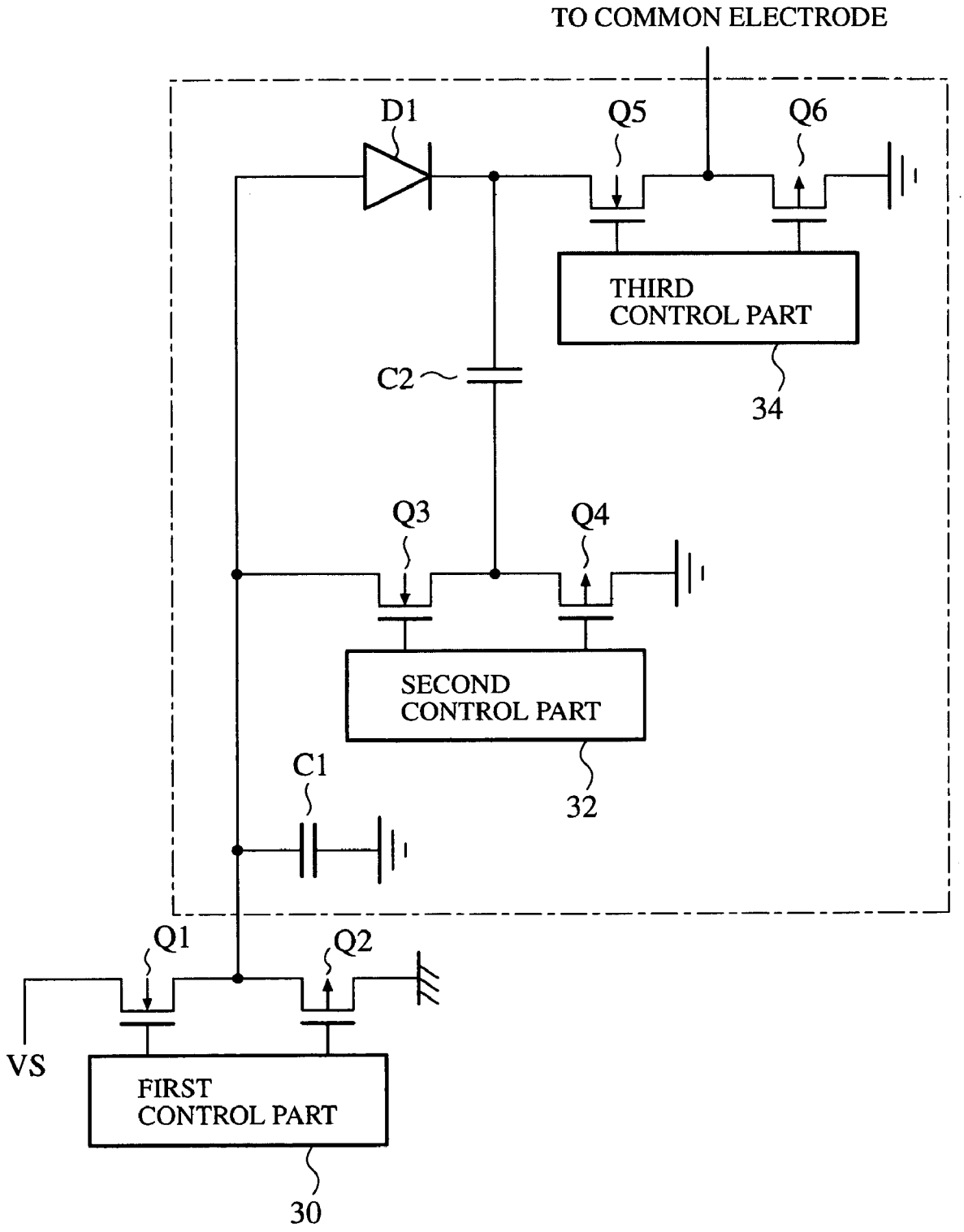
FIG. 4 is a connection diagram of a circuit for driving the common electrode in the display panel driving method of the present invention.

FIG. 4 shows a common electrode drive circuit. A 160-V power supply Vs is grounded via transistors Q1 and Q2. The transistors Q1 and Q2 have their gates connected to a first control part 30, and the transistors Q1 and Q2 are turned ON and OFF by control signals from the first control part 30. By turning ON the transistor Q1 and OFF the transistor Q2, the voltage $V_s$ is output from the node (a $V_s$ output point) intermediate between the transistors Q1 and Q2 to the next stage. The circuit by the transistors Q1 and Q2 is a circuit on the part of the power supply, which is formed on a circuit board different from that on which there are formed the following circuits indicated by the broken lines in FIG. 4, and it has a ground potential different from that of the latter.

Figure 19:
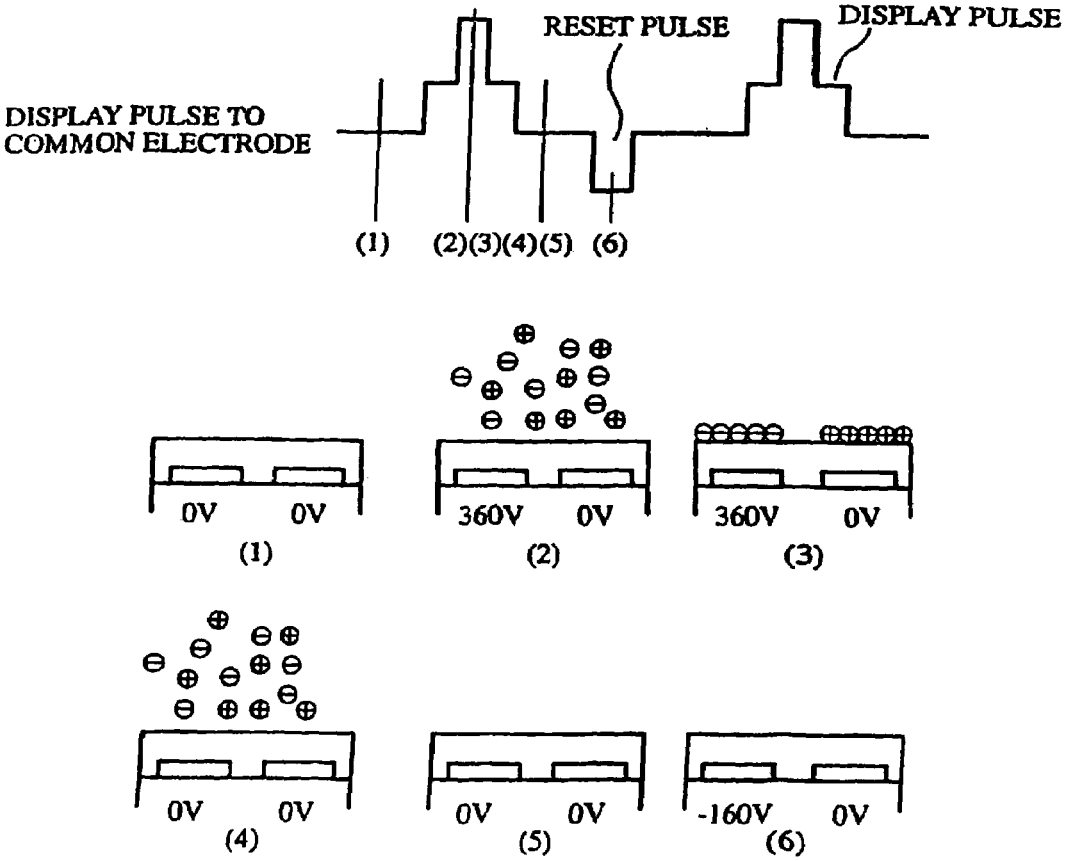
FIG.19 (BACKGROUND ART)
FIG. 19 is a diagram showing variations in the voltage waveform of the common electrode and variations of charges on the common electrode and the discrete electrode in the case of FIG. 18.

Connected to the intermediate node of the transistors Q1 and Q2 is a capacitor C1 grounded at the other end. Further, connected to the $V_s$ output point are transistors Q3 and Q4 grounded at one end. The transistors Q3 and Q4 have their gates connected to a second control circuit 32, and the ON-OFF operation of the transistors Q3 and Q4 is controlled by the second control circuit 32. Moreover, transistors Q5 and Q6 grounded at one end are connected to the $V_s$ output point via a diode D1. The transistors Q5 and Q6 have heir gates connected to a third control circuit 34, and the ON-OFF operation of the transistors Q5 and Q6 is controlled by the third control circuit 34. The transistors Q3, Q4, Q5 and Q6 are turned ON and OFF with the transistor Q1 held ON and the transistor Q2 OFF, as described below. As a result, he common electrode is supplied with such a two-step display pulse as depicted in FIG. 19. By bringing the rise-up time of the second-step pulse close to the rise-up time of the first-step pulse, a virtually one-step pulse is produced. The limit on the interval between the rise-up times of the both pulses depends on the transistor switching time.

TABLE 1

| | Q3 | Q4 | Q5 | Q6 |
|---|---|---|---|---|
| (1) AT the time of 0 V | OFF | ON | OFF | ON |
| (2) At the time of 1st-step pulse rise-up | OFF | ON | OFF | OFF |

TABLE 1-continued

| | Q3 | Q4 | Q5 | Q6 |
|---|---|---|---|---|
| (3) | OFF | ON | ON | OFF |
| (4) At the time of 2nd-step pulse rise-up | OFF | OFF | ON | OFF |
| (5) | ON | OFF | ON | OFF |
| (6) At the time of 2nd-step pulse falling | OFF | OFF | ON | ON |
| (7) | OFF | ON | ON | OFF |
| (8) At the time of 1st-step pulse falling | OFF | ON | OFF | OFF |
| (9) | OFF | ON | OFF | ON |

That is, the potential of the common electrode is reduced down to the ground potential (0 V) by turning OFF the transistor Q5 and Q6 ON, and the potential of the common electrode is raised to Vs by turning ON the transistor Q5 and OFF Q6. At this time, the transistor Q4 is held ON, by which charges equivalent to $V_s$ are stored in a capacitor C2. And, by turning OFF the transistor Q4 and ON Q3, the capacitor C2 is made to have the potential $V_s$ at its end connected to the transistor Q3. Since the capacitor C2 is charged corresponding to $V_s$, the voltage of the common electrode becomes $2V_s$. In this way, a second-step voltage 2 $V_s$ can be generated. And, by turning OFF the transistor Q3 and ON Q4, the voltage of the common electrode returns to $V_s$, and by turning OFF the transistor Q5 and ON Q6, the voltage of the common electrode returns to the power-supply voltage 0; thus, the two-step display pulse can be created.

Next, the transistor Q1 is turned OFF and Q2 ON with the transistor Q5 held OFF and Q6 ON. As a result, the upper potential of the capacitor C1 is fixed at the ground potential 0 V at its the power supply side. On the other hand, the lower-side ground potential of the capacitor C1 is the ground potential of this drive circuit, and is not always 0 V. Then, this ground potential becomes $-V_s$, and the potential of the common electrode grounded via the transistor Q6 becomes $-V_s$. Hence, the reset pulse shown in FIG. 19 is applied to the common electrode.

The reset pulse is opposite in polarity to the display pulse, and its magnitude is $V_s$ that is the same as that of the first-step pulse. This $V_s$ is, for example, 160 V (in the range of 150 V to 200 V), at which a discharge is caused when wall charges remain. Accordingly, the application of the reset pulse causes a discharge when the wall charges remain unremoved, and as a result, the wall charges are removed.

Figure 18:
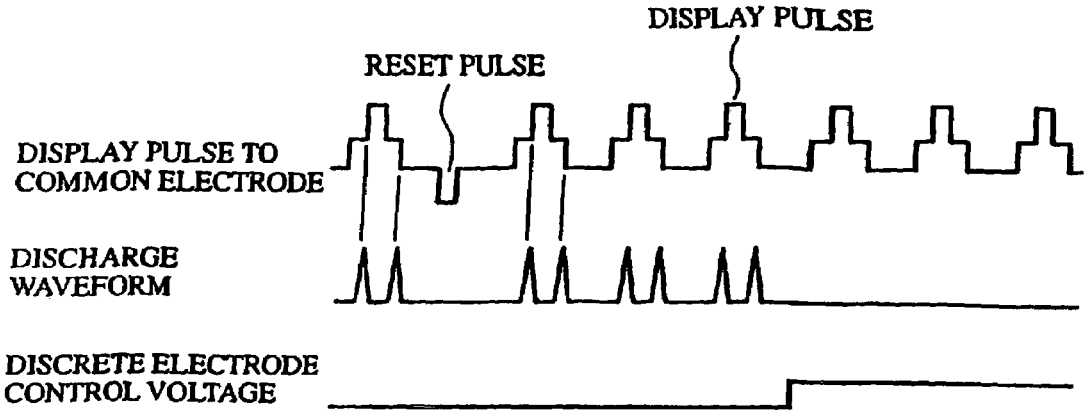
FIG.18 (BACKGROUND ART)
FIG. 18 is a diagram showing a display pulse applied to the common electrode, the discrete electrode control voltage and a discharge waveform in the case of a normal discharge in the invention described in the inventor's prior application.
Figure 20:
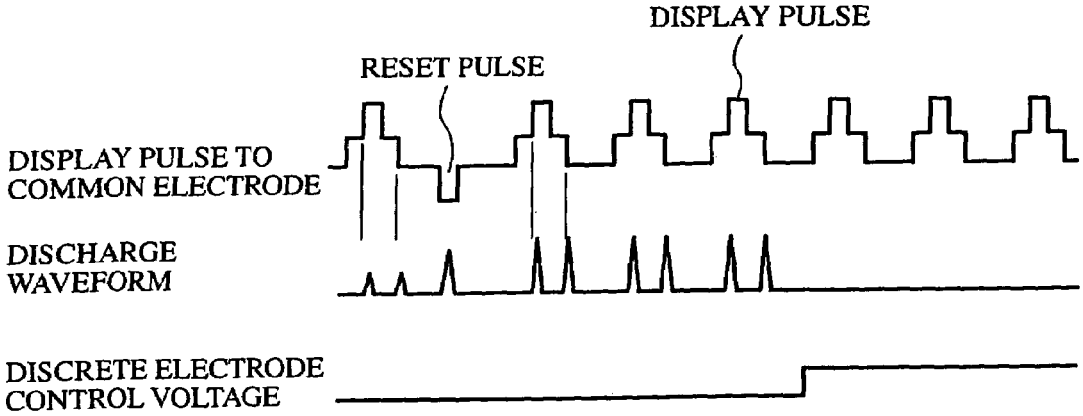
FIG.20 (BACKGROUND ART)
FIG. 20 is a diagram showing a display pulse applied to the common electrode, the discrete electrode control voltage and the discharge waveform in the case of an unstable discharge in the invention described in the inventor's prior application.

The relationship between the voltage application to the common electrode and the discrete electrode and the discharge is the same as described above with reference to FIGS. 18 to 21, except common electrode pulse following the reset pulse becomes one step. FIGS. 18 and 19 show the state of normal discharge, and FIGS. 20 and 21 the state of unstable discharge when wall charges remain unremoved. As described above, when an unstable discharge takes place and wall charges remain unremoved, the application of the reset pulses causes a discharge, removing the wall charges.

In this case, the erase pulse may preferably be of the order of the first-step voltage of the display pulse, and when wall charges persist, the application of this pulse ensures the charge removal discharge. Further, the generation of the reset pulse of the same voltage as the display pulse permits simplification of the drive circuit.

The reset pulse needs to be of long duration sufficient to ensure discharge when wall charges persist after the discharge for display. To ensure the discharge, a duration of about 5 $\mu$sec is required in this embodiment. This is influenced by the size of the display cell, for instance. The time of this discharge is the same as that of the discharge by the display pulse, and it is preferable to insert the reset pulse of about 5 μsec duration 15 μsec after or so after the fall of the display pulse to 0 (GND). Since the discharge time changes with the size of the display cell, the above-mentioned times 15 μsec and 5μsec both change. Then, the time interval from end of the display pulse to the start of the reset pulse and the duration of the reset pulse may preferably be set to a 3:1 ratio or so. Incidentally, this relationship applies to the case where the both times are each set to the smallest value; it does not matter if the both times are chosen sufficiently long.

Figure 16:
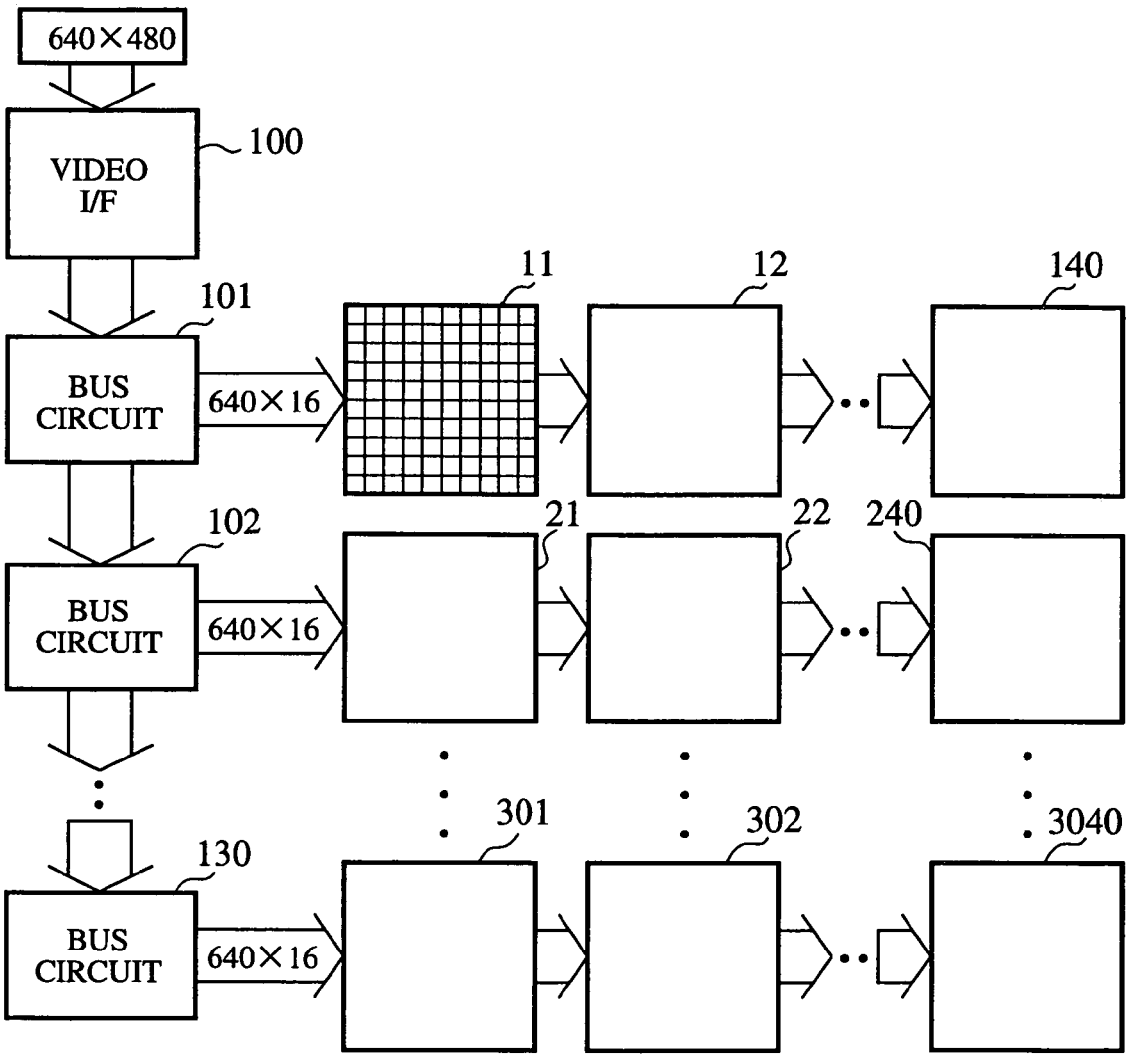
FIG. 16 is a diagram depicting the arrangement of the display panel and the transfer routes of control data to discrete electrodes.
Figure 17:
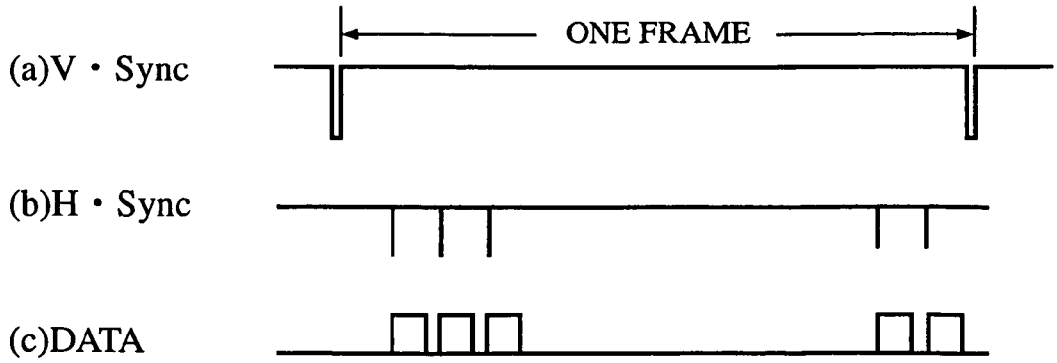
FIG. 17 is a diagram showing vertical and horizontal sync signals for driving the display panel and the transfer of control data to the discrete electrodes.

The arrangement of the display panel and the data transfer to the discrete electrode in this embodiment are the same as in FIGS. 16 and 17. However, the number of unit panels, each having 16 by 16 pixels, arranged in a matrix form in not limited specifically to 30 in column and 40 in row.

Figure 5:
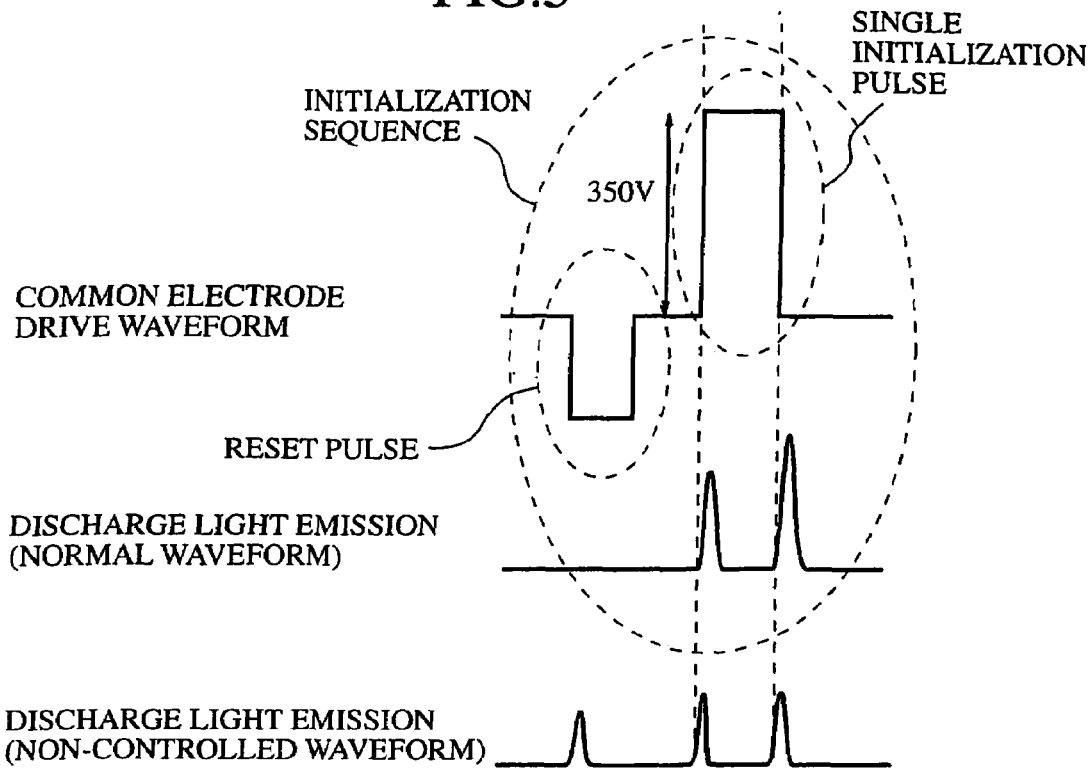
FIG. 5 is a waveform diagram showing an initialization sequence according to an embodiment of the display panel driving method of the present invention.
Figure 6:
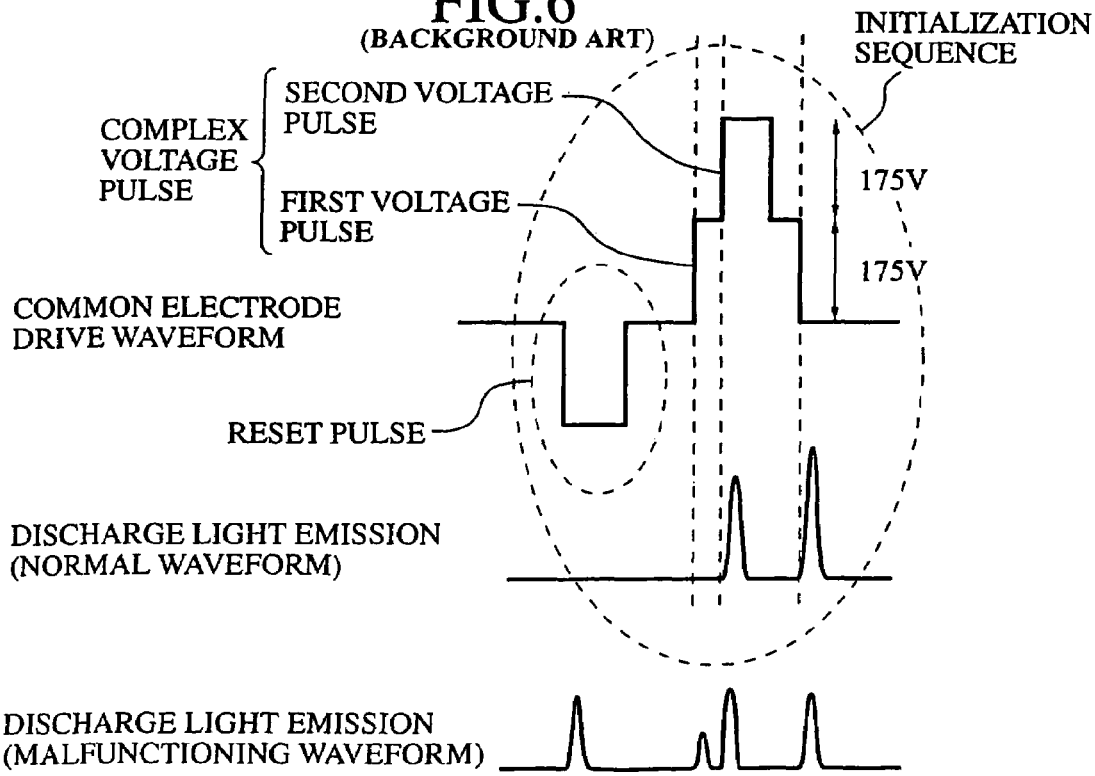
FIG.6 (BACKGROUND ART)
FIG. 6 is a waveform diagram showing the initialization sequence used in a conventional driving method.
Figure 21:
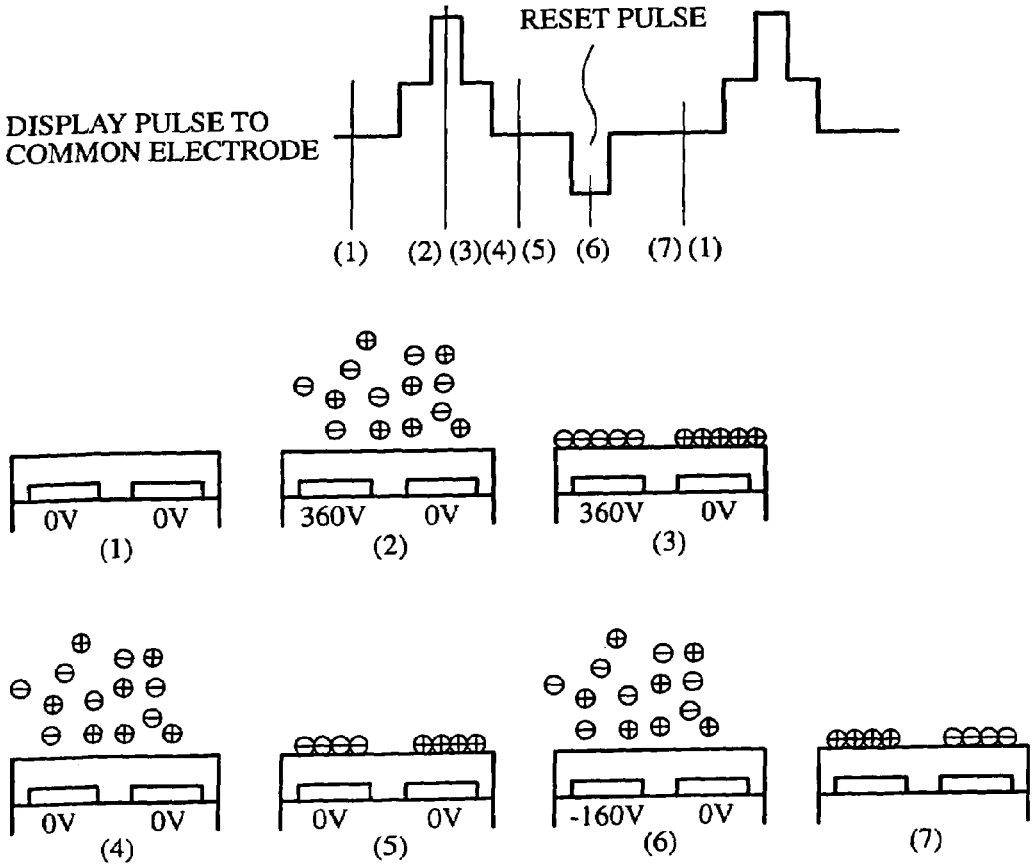
FIG.21 (BACKGROUND ART)
FIG. 21 is a diagram showing variations in the voltage waveform of the common electrode and variations of charges on the common electrode and the discrete electrode in the case of FIG. 20.

FIG. 5 shows the initialization sequence, waveforms being depicted in comparison with those in the FIG. 6 prior art example. The waveform of the initialization pulse applied to the common electrode in FIG. 5 is a waveform resulting from the simultaneous application of a first voltage pulse and a second voltage pulse superimposed thereon. The discharge light emission (normal waveform) shown has a discharge waveform when such a normal discharge as shown in FIG. 19 is caused. The discharge light emission (non-controlled waveform) has a discharge waveform when stored charges are present as depicted in FIG. 21. With such an initialization sequence as shown in FIG. 5, it is possible to avoid the state in which when the initialization pulse is applied under unstable conditions, the application of the first voltage pulse causes a false discharge at a voltage above the discharge start voltage under the influence of residual charges or the like as indicated by the non-controlled waveform in FIG. 5. In the case of the non-controlled waveform in the FIG. 6 prior art example, a false discharge occurs at the leading edge of the first voltage pulse. Further, by causing the first and second voltage pulses to fall at one stroke to apply a large potential difference at one time, it is possible to obtain a larger charge removal discharge than in the case of causing the voltage pulses to fall separately.

In this display panel, 175 V is applied as the first and second voltage pulses, and the resulting discharge occurs 0.4 μs after the voltage application. At present, the voltage rise-up by high voltage switching takes 0.3 μs; hence, by applying the second voltage to be superimposed on the first voltage within 0.1 μs after the duration of the first voltage pulse, it is possible to obtain a pulse waveform that satisfies the above requirement. By the rise-up of the second voltage pulse within 1 μs after the rise-up of the first voltage pulse, the false discharge can be prevented to some extent.

The time width during which the second voltage pulse falls and the first voltage pulse is applied is made shorter than 0.1 μs to apply a large voltage difference at the time of the fall, by which a larger charge removal discharge can be implemented, and as a result, stable control can be performed.

The initialization sequence shown in FIG. 5 is performed once per frame or frames.

In the initialization sequence in FIG. 5, the reset pulse precedes the initialization single pulse but the order of the both pulses may be reversed.

Embodiment 2

Figure 7:
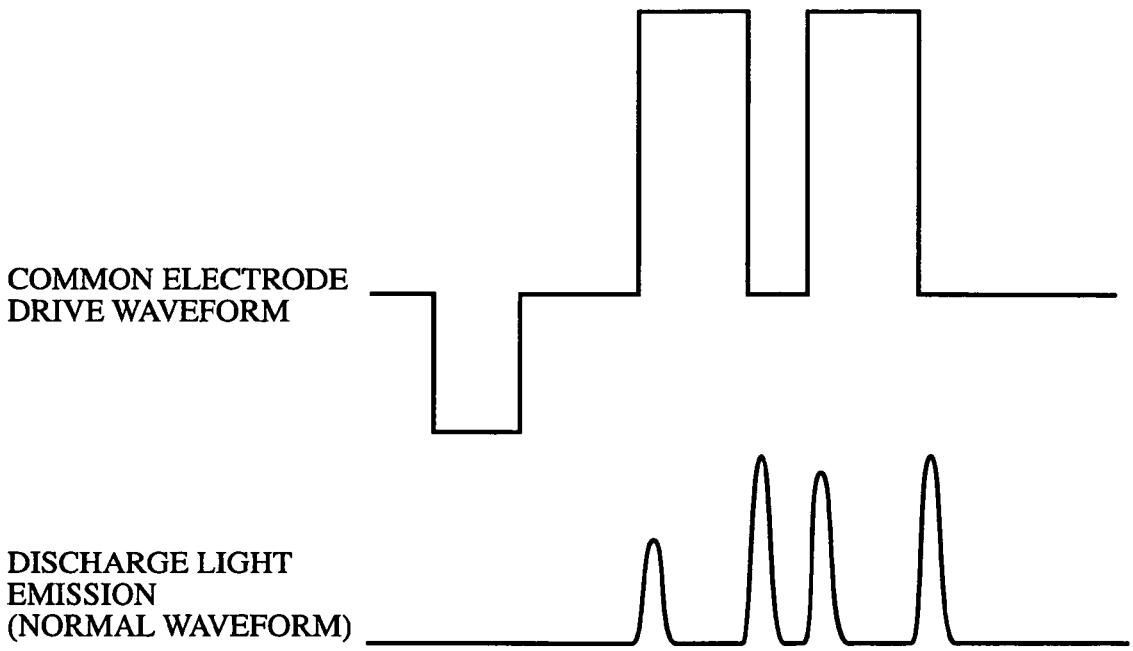
FIG. 7 is a waveform diagram showing an initialization sequence using two initialization pulses in succession in the display panel driving method of the present invention.

Further, the positive initialization sequence pulse that is applied to the common electrode may also be divided into two as depicted in FIG. 7. In the case where a pulse by the sequence of the previous frame is not immediately followed by the application of the initialization pulse or where the discharge is suppressed in the previous frame, the first discharge in the next frame may sometimes become unstable. To solve this problem, the initialization sequence is used for stable discharge; but the addition of one more pulse ensures re-charging after the first discharge, thereby providing increased stability.

Embodiment 3

Figure 8:
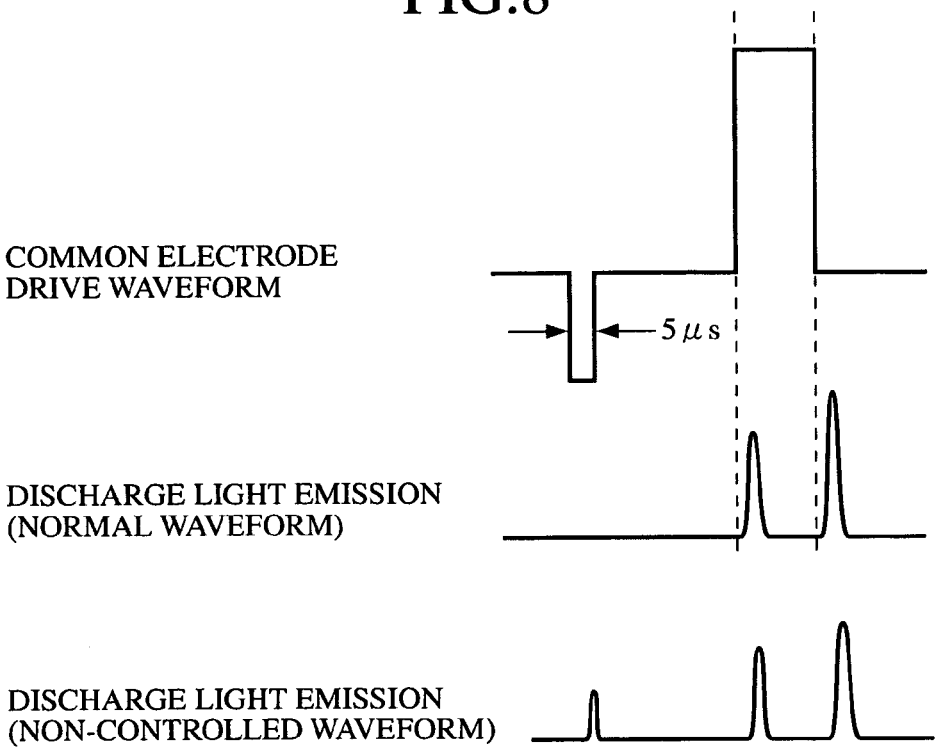
FIG. 8 is a waveform diagram showing an initialization sequence using a reset pulse of a less-than-5-$\mu$s duration in the display panel driving method of the present invention.

Moreover, the width of the reset pulse is reduced as shown in FIG. 8. This prevents that a cell in its stable discharge state is caused by an unnecessary reset pulse to perform a false discharge. Such a false discharge is likely to occur in the case of keeping on applying voltage to the display cell. Accordingly, the probability of occurrence of the false discharge increases with an increase in the reset pulse application period. Further, in the case of initialization by the reset pulse during an unstable discharge shown in FIG. 21, a discharge light emission occurs 0.3 μs to several μs after the fall of the reset pulse. On this account, setting the rest pulse width to about 5 μs makes it possible to prevent the stable-state cell from a false discharge while maintaining the reset function.

Figure 9:
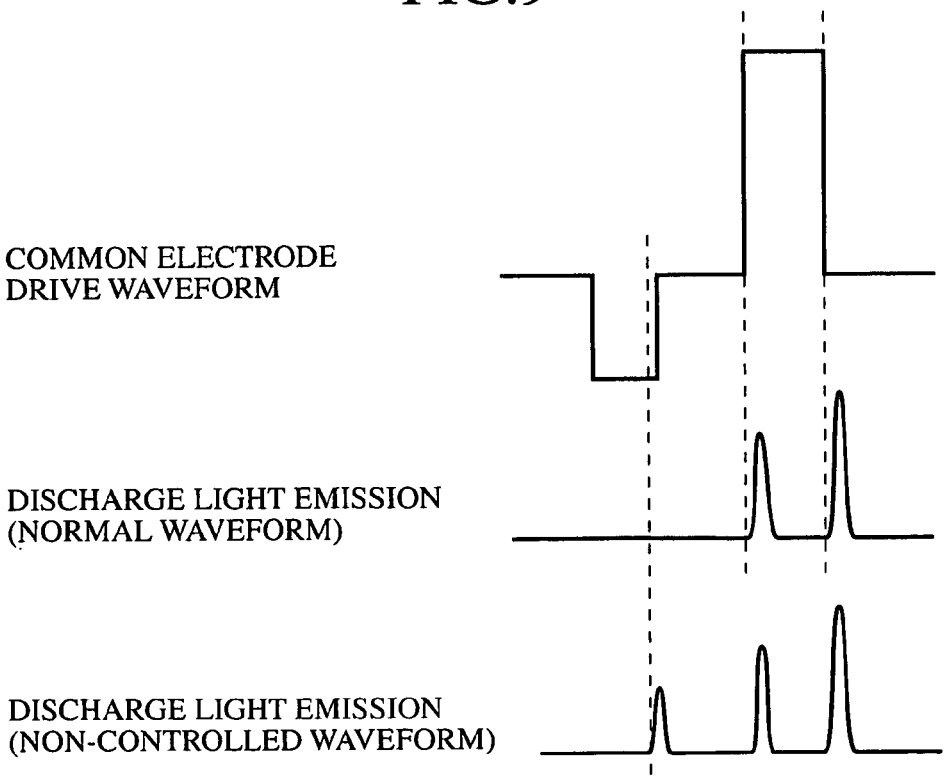
FIG. 9 is a waveform diagram showing a basic initialization sequence for use in the display panel driving method of the present invention.

FIG. 9 shows a waveform diagram in the case of Embodiment 1 in which the width of the reset pulse is not reduced.

Embodiment 4

Figure 10:
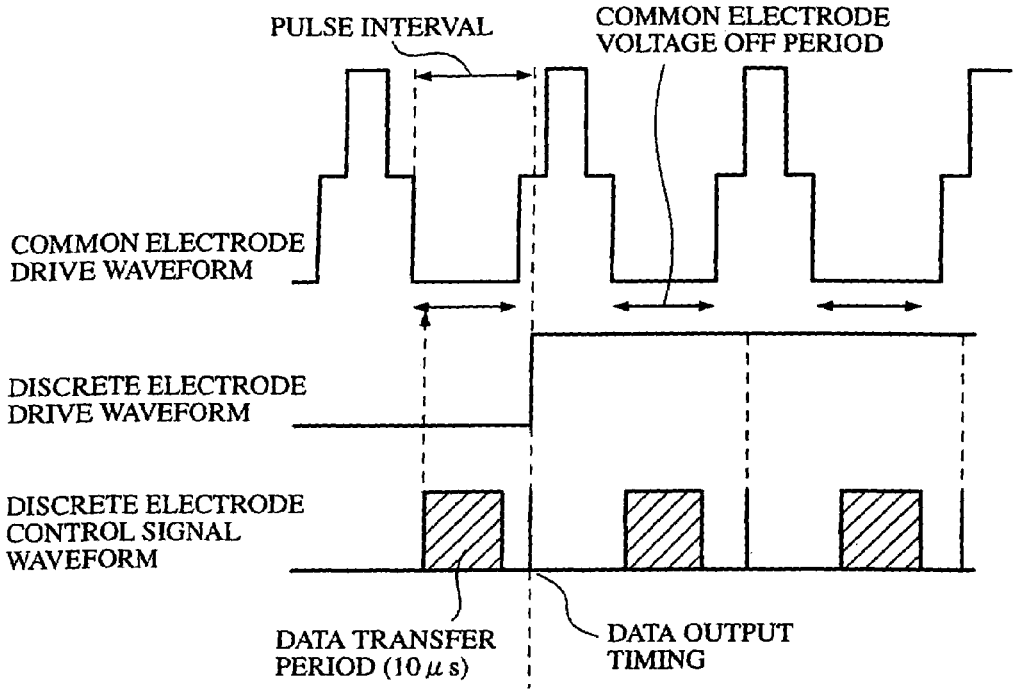
FIG. 10 is a waveform diagram showing the applied voltage of the common electrode, the period of control data transfer to the discrete electrode, and the voltage waveform of the discrete electrode in another embodiment of the display panel driving method according to the present invention.

FIG. 10 shows driving waveforms including a signal waveform for setting the output timing of the discrete electrode. Usually, a suppression pulse to be applied to the discrete electrode (in this case, the applied voltage being set to 115 V) is set to rise up during interval between voltage applications to the common electrode. For voltage application with certain timing, it is necessary to set the ON-OFF timing for individual discrete electrodes of the entire panel, and a data transfer period for all the electrodes is required. By simultaneously outputting the data sent during the transfer period with the voltage applying timing, the discrete electrodes of all the cells can be turned ON/OFF at the same timing. Since this data is usually driven by an element called a high voltage driver IC, the data transfer is carried out by a logic circuit. During the voltage application to the common electrode, an appreciable amount of noise is caused by the switching of the high voltage pulse that is applied to the common electrode. For example, if this noise affects the transferred data, it affects the data transfer operation as CLK noise, or H/L of the data itself is reversed and the voltage application to the discrete electrode is reversed—this gives rise to the problems such as the reversal of light emission and non-emission, false lighting and non-lighting state.

Accordingly, by setting the data transfer period for the discrete electrode in the interval between the voltage applications to the common electrode, it is possible to eliminate the influence of noise without fail.

For example, 4-bit data is transferred at 5 MHz to 192 discrete electrodes of the panel. In this case, since the data transfer calls for at least $$192/4\times1/(5\times10^6)=9.6\ \mu s,$$

about 10 μs is set as the time width during which no voltage is applied to the common electrode.

Further, assume that the data output point is set in the period of the first voltage pulse of the complex pulse to be applied to the common electrode and prior to the superimposition thereon of the second voltage pulse on the first one. In this case, since the first voltage pulse is set below the discharge start voltage, the voltage of the discrete electrode will not affect the discharge when stable light emission continues.

This provides a margin in the period for sending data for the voltage application t the discrete electrode. Further, by lengthening the time interval between the immediately previous pulse applied to the common electrode and the driving of the discrete electrode, it is possible to provide a sufficient amount of time for space charges resulting from the removal discharge having occurred at the fall of the pulse applied to the common electrode decrease in the cell space. When the space charge remains in the cell, this charge promotes discharge and hence lowers the discharge start voltage as an externally applied voltage value, increasing the possibility of false discharge. With the above-mentioned time interval sufficiently lengthened, it is possible to lessen the influence of the space charge, leading to an increase in the margin voltage.

Figure 11:
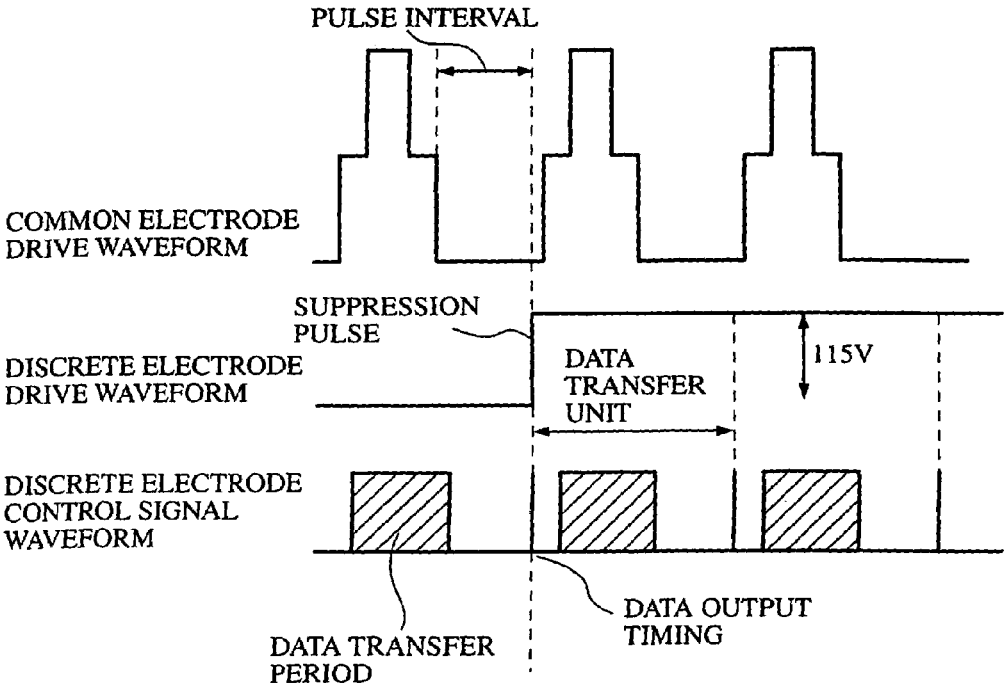
FIG.11 (BACKGROUND ART)
FIG. 11 is a waveform diagram showing the voltage waveform of the common electrode, the period of control data transfer to the discrete electrode, and the voltage waveform of the discrete electrode.

FIG. 11 shows, for the purpose of comparison, the data output timing of the discrete electrode and the voltage waveform applied to the common electrode in the prior art.

Figure 12:
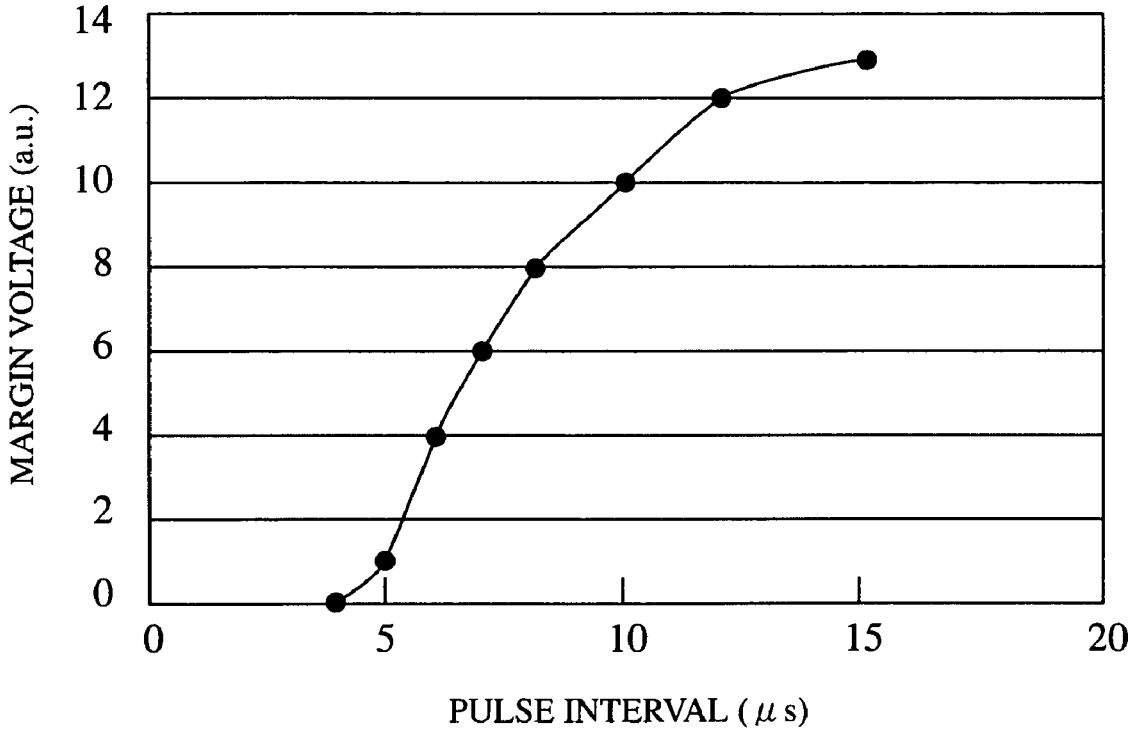
FIG. 12 is a diagram showing the relationship between the pulse interval from the fall of the common electrode voltage to the rise-up of a suppression pulse to be applied to the discrete electrode and a margin voltage.

FIG. 12 shows the relationship between the pulse interval from the fall of the pulse applied to the common electrode to the rise-up of the pulse to be applied to the discrete electrode and the common electrode voltage (margin voltage) that can be controlled. In this display panel, to set a sufficient margin voltage that can be controlled without causing false discharge, a time width is set 10 $\mu$s or more after the fall of the pulse applied to the common electrode to thereby secure the margin voltage. In this case, since the rise-up point of the pulse to be applied to the discrete electrode is in the first voltage pulse period of the complex pulse to be applied to the common electrode and prior to the superimposition thereon of the second voltage pulse, the pulse interval can be increased approximately 2 $\mu$s or so, as a result, the margin voltage increases about 2 V.

Embodiment 5

Figure 13:
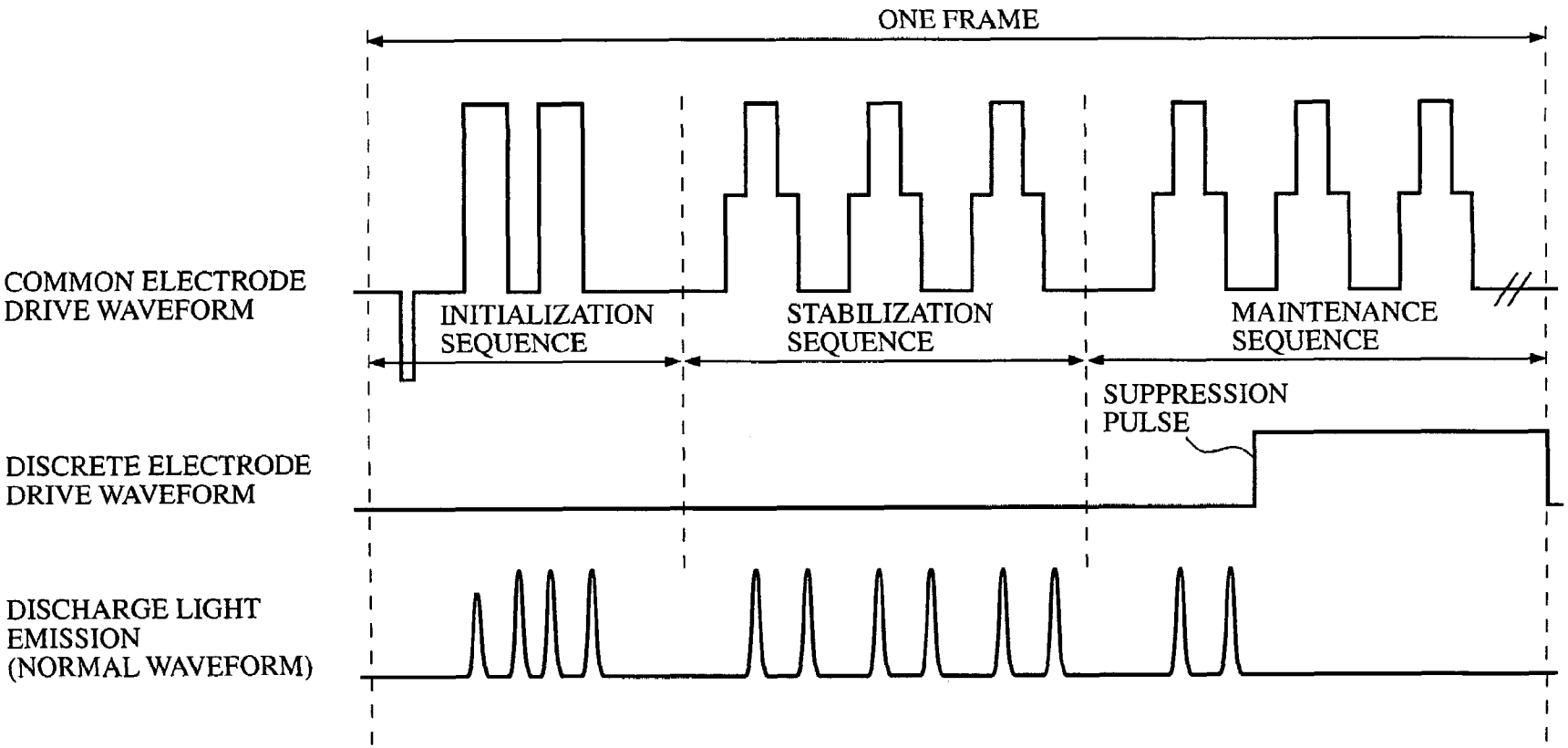
FIG. 13 is a waveform diagram showing the display panel driving method of the present invention which involves a stabilization sequence.

FIG. 13 depicts driving waveforms for the common electrode and the discrete electrode. A pulse similar to the maintenance pulse is applied to the common electrode as a stabilization sequence between the initialization sequence that is inserted once per frame or frames and the maintenance sequence for maintaining the discharge. It is empirically known that the insertion of the stabilization sequence causes repetition of a certain discharge emission about the beginning of the frame to bring all the cells into their stable state, thus preventing false discharge. The larger the number of stabilization pulses, the higher the stability; however, since luminance is determined by the number of pulses, the insertion of many stabilization pulses in each frame increases the brightness (luminance level) of a black display, resulting in impaired contrast of the display image.

Figure 14:
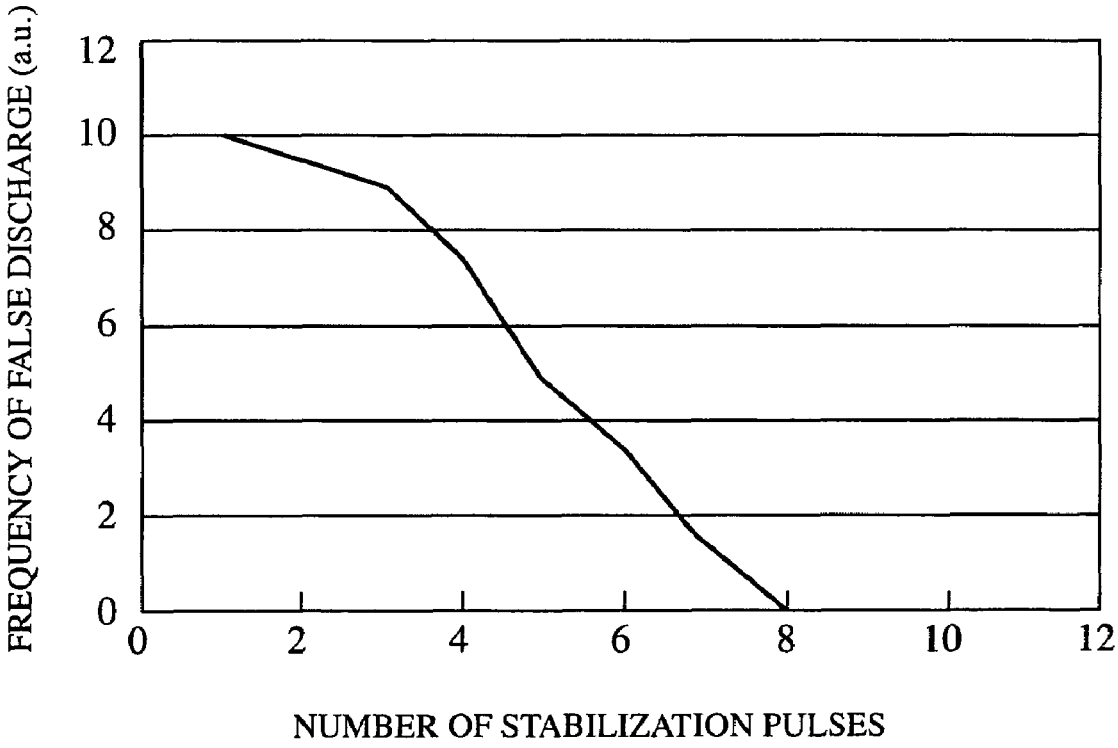
FIG. 14 is a diagram showing the relationship between the number of stabilization pulses and the frequency of occurrence of false discharge in the stabilization sequence in FIG. 13.

FIG. 14 shows the relationship between the number of stabilization pulses and the number of occurrences of false discharge under a certain unstable condition. The false discharge mentioned herein is a low-frequency (below 1 Hz) visible false discharge that is caused by the lack of a certain amount of wall charge in the cell, and it can be seen that the occurrence of false discharge could be avoided by increasing the number of stabilization pulses used. By setting the number of stabilization pulses to eight in this case, it is possible to achieve stabilization and minimize the deterioration of contrast.

Embodiment 6

Figure 15:
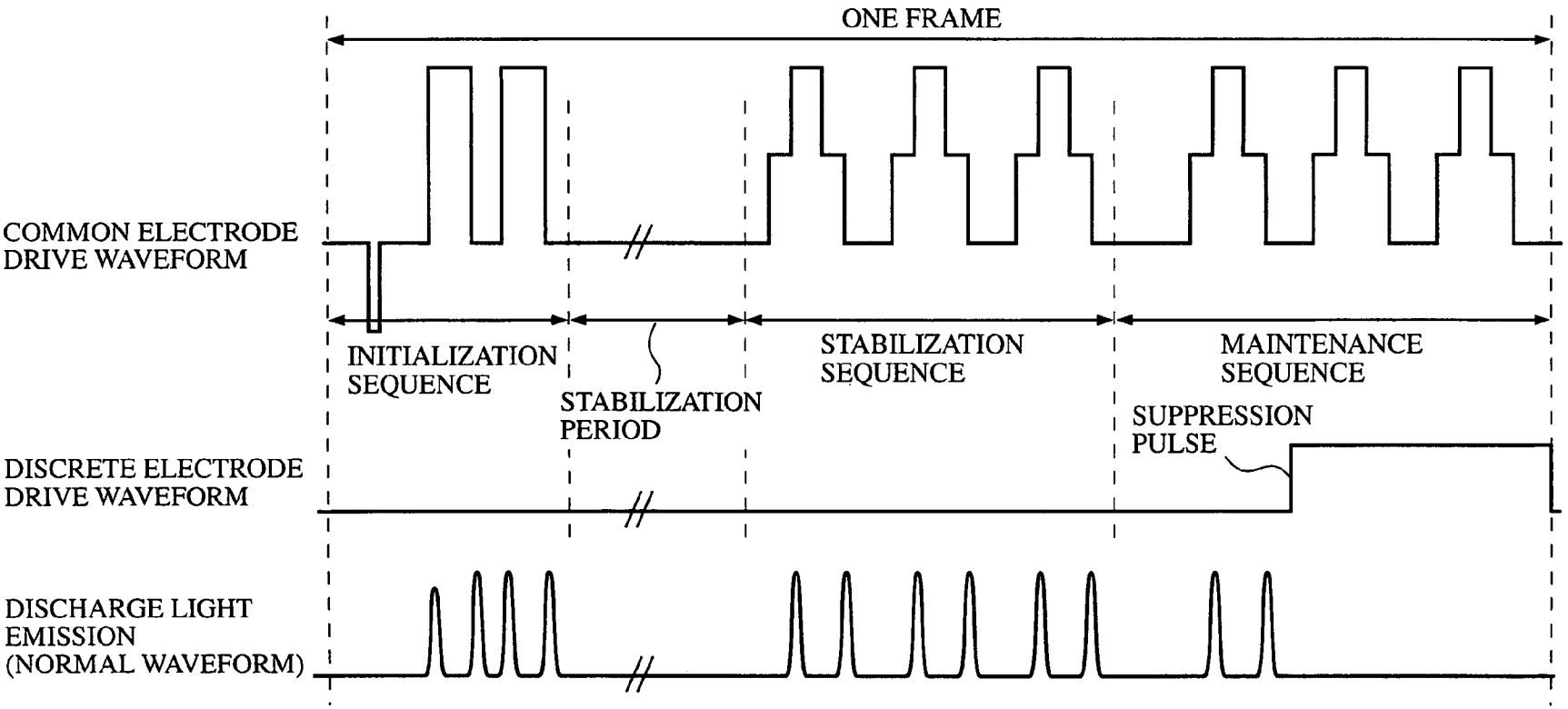
FIG. 15 is a waveform diagram showing the display panel driving method of the present invention in which a stabilization period is provided.

FIG. 15 shows driving waveforms for the common electrode and the discrete electrode. As shown, a certain stabilization period is provided between the initialization sequence and maintenance sequence for the common electrode. In particular, after a single initialization pulse, a large erasing discharge occurs in every cell, and space charge is created in large quantities over the entire panel; accordingly, the amount of space charge remaining increases and it also remains for a long time. Hence, the discharge by the immediately subsequent pulse voltage application is readily affected by the space charge—this leads to the occurrence of false discharge and the reduction in the margin. Therefore, the influence of space charge could be avoided by setting a sufficient time width between the initialization sequence inserted once per frame or frames and the discharge maintaining pulse.

Further, in the case of using the stabilization sequence described above in Embodiment 5, it is possible to achieve stabilization by Embodiment 5 and avoid the influence of false discharge by similarly setting a sufficient time width between the initialization sequence and the stabilization sequence, or between the stabilization sequence and the discharge maintaining sequence.

In this case, however, too long a stabilization period limits the number of pulses that can be inserted in the frame, resulting in decreasing the maximum luminance. Hence, the stabilization period needs to be set to an appropriate value according to the display luminance and power of the panel specifications. In this embodiment the stabilization period is set to about 1 ms for one frame 16.6 ms long.

The invention claimed is:

1. A method for driving a display panel, in which a common electrode and a discrete electrode are connected to one of plural display cells arranged in a matrix form, the method comprising the steps of:

(a) supplying said common electrode with a reset pulse opposite in polarity to a display pulse, the reset pulse for inversion of charges stored on said common electrode;

(b) supplying said common electrode with a first single-step pulse of the same polarity as said display pulse;

(c) applying said display pulse to the common electrode; and (d) applying a control voltage to said discrete electrode to thereby control a gaseous discharge in said one of plural display cells.

2. The display panel driving method according to claim 1, wherein said step (b) is performed twice in succession.

3. The display panel driving method according to claim 1, wherein the duration of said reset pulse is equal to or smaller than 5 $\mu$s.

4. The display panel driving method according to claim 1, wherein step (b) further comprises supplying a second single-step pulse, of the same polarity as said display pulse, to the common electrode within 1 $\mu$s after the rise of first single-step pulse.

5. A method for driving a display panel, in which a common electrode and a discrete electrode are connected to one of plural display cells arranged in a matrix form, the method comprising the steps of:

applying a display pulse to the common electrode;

applying a control voltage to the discrete electrode to thereby control a gaseous discharge in said one of plural display cells; and transferring data, for controlling a period of the gaseous discharge in said one of plural display cells, to a drive circuit of the discrete electrode substantially when no voltage is applied to the common electrode.

6. The display panel driving method according to claim 5, wherein a voltage of the display pulse rises in two steps, and the application of the control voltage to the discrete electrode is started following the rise of a first-step voltage and preceding the rise of a second-step voltage.

7. A method for driving a display panel, in which a common electrode and a discrete electrode are connected to one of plural display cells arranged in a matrix form, the method comprising the steps of:

(a) applying an initialization sequence voltage to the common electrode;

(b) applying a stabilization sequence in which at least one display pulse is applied to the common electrode to perform a stabilizing gaseous discharge of each of said plural display cells; and (c) controlling a period of the gaseous discharge in said one of plural display cells by controlling a period in which to apply said display pulse to the common electrode and in which to apply a discharge suppression pulse to the discrete electrode.

8. The display panel driving method according to claim 7, wherein a stabilization period in which not to apply voltages to both of the common electrode and the discrete electrode of said each of said plural display cells is set between at least one of the steps (a) and (b) and the steps (b) and (c).

9. A method for driving a display panel, in which a common electrode and a discrete electrode are connected to one of plural display cells arranged in a matrix form, the method comprising the steps of:

(a) removing charges that trigger an unintended discharge of the one of plural display cells during a stabilization period in which voltages are not applied to either the common electrode or the discrete electrode;

(b) applying a display pulse to the common electrode to perform a gaseous discharge of said display cell; and (c) controlling a period of the gaseous discharge in said one of plural display cells by controlling a period in which to apply said display pulse to the common electrode and in which to apply a discharge suppression pulse to the discrete electrode.

10. The display panel driving method according to claim 1, wherein a ratio of a first duration, from a termination of said display pulse to a start of said reset pulse, to a second duration, of said reset pulse, is approximately 3:1.

11. The display panel driving method according to claim 4, wherein in step (b), the second single-step pulse falls within 1 $\mu$s after a falling of the first single-step pulse.

* * * * *